US006478243B2

(12) United States Patent
Fujiwara

(10) Patent No.: US 6,478,243 B2
(45) Date of Patent: Nov. 12, 2002

(54) DEVICE AND METHOD FOR SHREDDING FOOD WASTE

(75) Inventor: Shintaro Fujiwara, Ichikawa (JP)

(73) Assignee: Exy Concept Co., Ltd., Kashiwa (JP)

( * ) Notice: Subject to any disclaimer, the term of this patent is extended or adjusted under 35 U.S.C. 154(b) by 20 days.

(21) Appl. No.: 09/740,833

(22) Filed: Dec. 21, 2000

(65) Prior Publication Data

US 2001/0006198 A1 Jul. 5, 2001

(30) Foreign Application Priority Data

Dec. 28, 1999 (JP) ..... 11-372547

(51) Int. Cl.[7] ..... B02C 19/00

(52) U.S. Cl. ..... 241/21; 241/60; 241/100

(58) Field of Search ..... 241/60, 61, 100, 241/101.2, 21

(56) References Cited

U.S. PATENT DOCUMENTS 4,423,987 A 1/1984 Powers

FOREIGN PATENT DOCUMENTS

| | | |
|---|---|---|
| EP | 0906877 | 7/1999 |
| TW | 328920 | 11/1985 |
| TW | 396862 | 12/1987 |

*Primary Examiner*—Mark Rosenbaum
(74) *Attorney, Agent, or Firm*—Varndell & Varndell, PLLC

(57) ABSTRACT

A method and a device in which food waste is conveyed to a storage tank from an inlet using a difference in air pressure between the inlet and the storage tank.

6 Claims, 7 Drawing Sheets

DEVICE AND METHOD FOR SHREDDING FOOD WASTE

BACKGROUND OF THE INVENTION

1. Field of the Invention

The present invention relates to a device and a method for shredding food waste, and more particularly to a device and a method for shredding food waste in which food waste is conveyed into a storage tank using a difference in air pressure between an inlet and the storage tank.

2. Description of the Related Art

In conventional food waste shredding devices, a feeding-in piston 15 is disposed inside a taking-in portion 4, as shown in FIG. 8.

Food waste 16 introduced into an inlet 1 firstly passes, as shown in FIG. 9, between the feeding-in piston 15 and a feeding-in valve 14. Next, as shown in FIG. 10, the feeding-in valve 14 is opened and the food waste 16 is moved along by a fixed distance A inside the taking-in portion 4 by the feeding-in piston 15.

Next, as shown in FIG. 11, the feeding-in valve 14 is closed and then food waste 17 which has been introduced from the inlet 1 passes between the feeding in piston 15 and the feeding-in valve 14. Then, the food waste 17 is moved along by a fixed distance A in the same way as the previous food waste 16.

At this time, as shown in FIG. 12, the food waste 17 pushes the food waste 16 into the taking-in portion 4 approximately by the distance A. By repeating these steps, the food waste present in the taking-in portion 4 is conveyed to a storage tank 2 by being pushed along by the food waste introduced from the inlet 1, as shown in FIG. 13.

In this way, in the conventional method, the food waste fed into the inlet was conveyed to the storage tank successively by being pushed along, with the result that it took some time for the food waste to be fed into the storage tank. Because of this, there were problems in that unpleasant smells produced by the food waste present inside the inlet and taking-in portion was able to percolate through into the surroundings of the inlet and the positioning of the inlet was restricted.

In addition, there was the possible sanitary problems posed by food waste which began to decompose inside the taking-in portion when food waste had not been introduced into the inlet for a prolonged period. This problem of food waste decomposing inside the taking-in portion is reduced if the interior of the taking-in portion is. dried but in that case there is the problem that the drying of the food waste inside the taking-in portion causes it become stuck and block the taking-in portion.

Because such problems as the decomposition and drying of the food waste occur more easily the greater the distance between the inlet and the storage tank, these problems impose restriction to the length of the taking-in portion together with the problem of the friction between the food waste and the interior wall of the taking-in portion.

Furthermore, as a result of food waste being pushed into the storage tank, there were problems in that the sealing material between the feeding-in piston and the taking-in portion was subjected to abrasion, and water contained in the food waste introduced into the taking-in portion penetrated between the sealing material and the side wall of the taking-in portion, so that it became difficult to convey into the storage tank the water present in the taking-in portion.

This has made it necessary to perform maintenance work on the feeding-in piston.

SUMMARY OF THE INVENTION

In view of the problems described above, the object of the present invention is to propose a food waste shredding device in which it is possible to prevent the unpleasant smells produced by the food waste present inside the inlet and the taking-in portion from hanging in the surroundings of the inlet and in which the length of the taking-in portion is freely adjustable.

In order to overcome the abovementioned problems, the food waste shredding device according to the present invention, which is provided with an inlet into which food waste is fed, a cutter which shreds the food waste, a storage tank which stores the shredded food waste and an outlet which discharges food waste, comprises a taking-in portion which connects the inlet and the storage tank and a discharge portion which connects the storage tank and the outlet and is provided with an evacuator device which evacuates the interior of the taking-in portion and the interior of the storage tank.

In addition, the method of shredding food waste according to the present invention comprises a shutting-off step which shuts off the taking-in portion using the taking-in portion shut-off valve, an evacuation step which evacuates the storage tank and the taking-in portion between the taking-in portion shut-off valve and the storage tank after the shutting-off step after the shutting-off step, and a step in which the shut-off valve is opened after the evacuation step.

Then, in the present invention, the food waste is conveyed from the inlet to the storage tank using a difference in air pressure between the inlet and the storage tank.

For this reason, the food waste is conveyed from the inlet to the storage tank in one go, and even if the food waste is not introduced into the inlet for a prolonged period, the food waste does not remain inside the taking-in portion. Consequently, it is possible to prevent the problems of the decomposition of the food waste inside the inlet and the blocking of the taking-in portion as a result of dried food waste sticking to the interior walls of the taking-in portion. In addition, the distance between the inlet and the storage tank can be freely adjusted.

Furthermore, since the air surrounding the inlet is also sucked into the storage tank, it is possible to prevent the problem of the smell of the food waste in the surroundings of the inlet.

In addition, in the present invention, it becomes possible to reduce the frequency of maintenance work that is required due to abrasion of the sealing material between the feeding-in piston and the taking-in portion and it becomes possible to convey even liquid food waste from the inlet to the storage tank without any problems whatsoever.

In addition, by managing signals from a detection sensor and state sensors at a control center it. is possible to organize the circulation of collection vehicle efficiently. Further, it is possible to respond quickly to troubles of the food waste shredding device.

DESCRIPTION OF THE PREFERRED EMBODIMENTS

Figure 1:
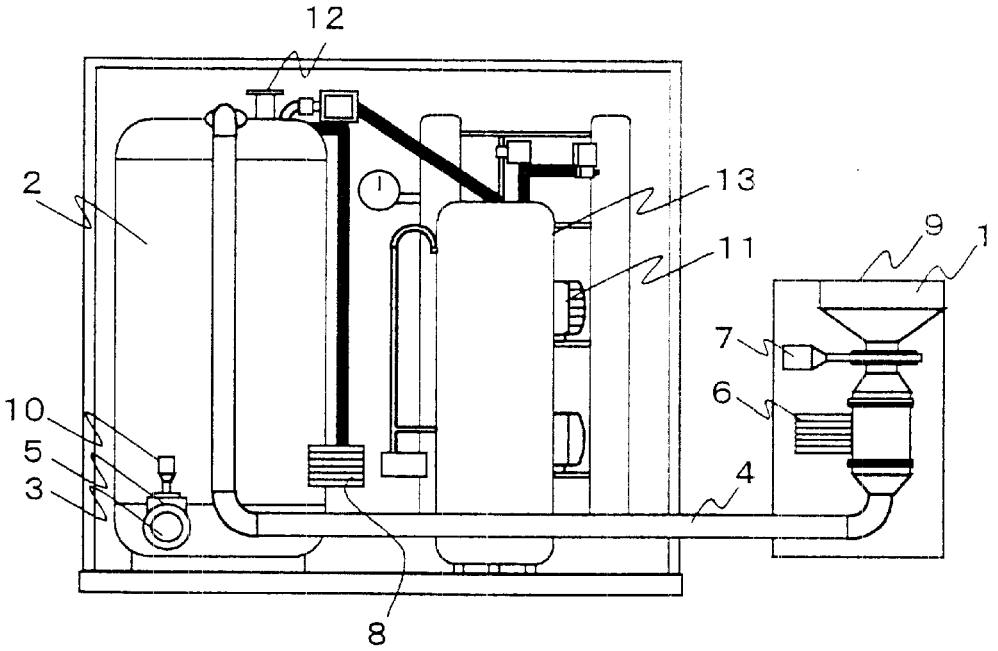
FIG. 1 is a conceptual diagram of a food waste shredding device according to the present invention.
Figure 2:
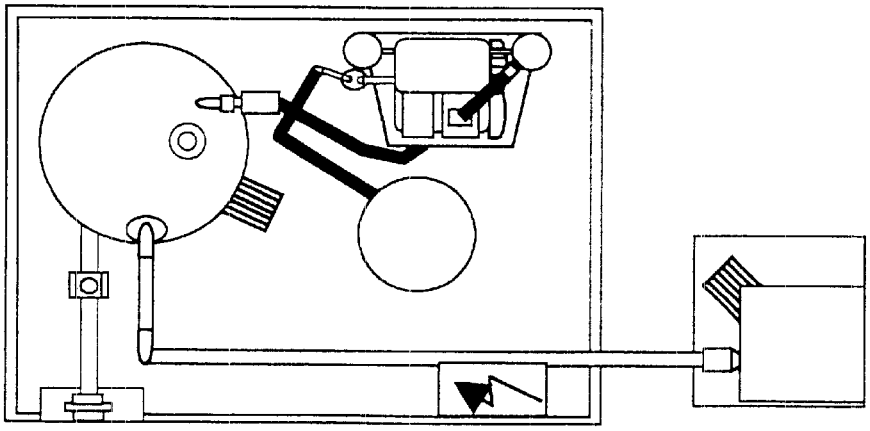
FIG. 2 is a conceptual diagram of a food waste shredding device according to the present invention.

As shown in FIGS. 1 and 2, the food waste shredding device according to the present invention comprises an inlet 1 into which food waste is introduced, a storage tank 2 which stores the food waste which has been shredded and an outlet 3 which discharges the shredded food waste. In addition, the inlet 1 and the storage tank 2 are connected by a taking-in portion 4, and the storage tank 2 and the outlet 3 are connected by a discharge portion 5.

Then, an inlet door 9 is arranged on the inlet 1, and a shredding cutter 6 and an inlet shut-off valve 7 are arranged in the taking-in portion 4, while a discharge portion shut-off valve 10 is arranged in the discharge portion 5. The inlet shut-off valve 7 arranged in the taking-in portion 4 is arranged between the inlet 1 and the shredding cutter 6.

In addition, an evacuator device 11 which evacuates at least the interior of the storage tank 2 and a shredding cutter 8 is provided inside the storage tank 2. It is also possible to arrange the evacuator device 11 in the taking-in portion 4.

Preferably, a slurry quantity detection sensor 12 which detects the quantity of food waste present in the storage tank 2 is arranged in the storage tank 2.

Preferably, pressurizing device 13 which pressurizes the interior of the storage tank 2 is arranged in the storage tank.

Figure 3:
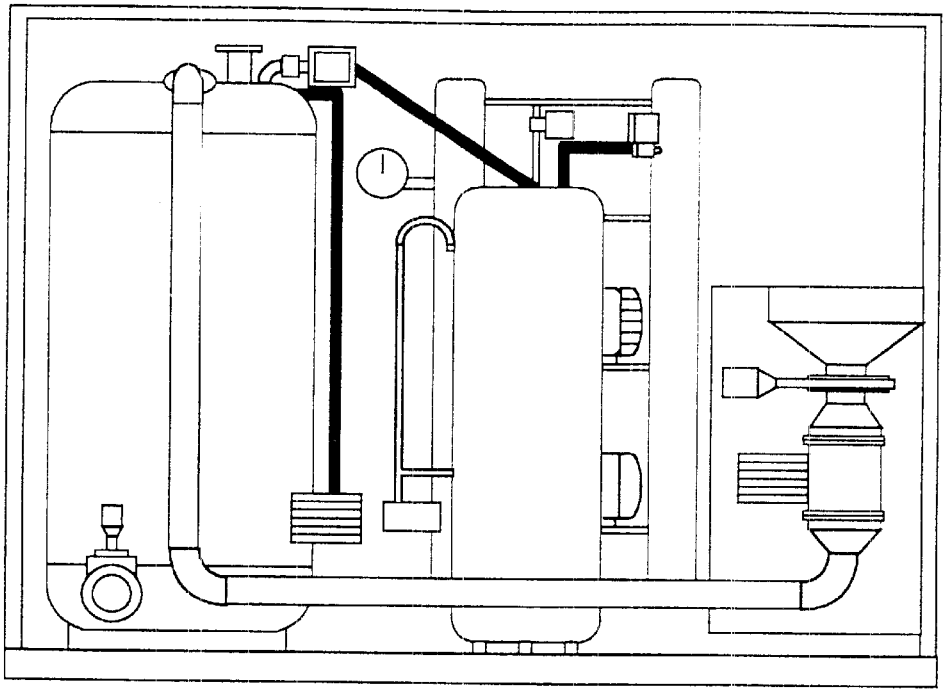
FIG. 3 is a conceptual diagram of a food waste shredding device according to the present invention.
Figure 4:
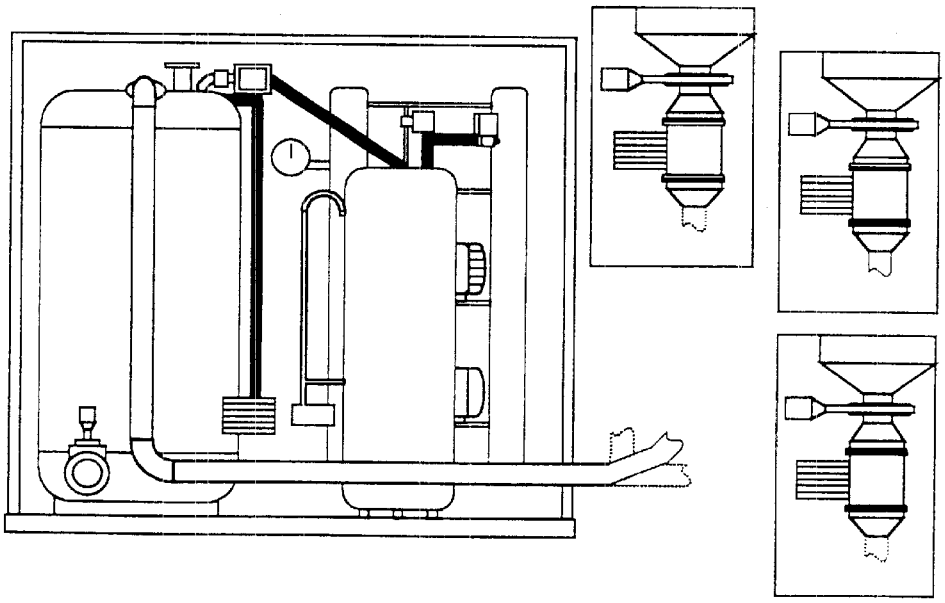
FIG. 4 is a conceptual diagram of a food waste-shredding device according to the present invention.

In addition, as shown in FIG. 3, the components from the inlet 1 to the outlet 3 may be mounted in one packaging. Furthermore, as shown in FIG. 4, it is possible to connect a plurality of taking-in portions 4 to one storage tank.

An embodiment of the present invention will be explained below using the figures.

Figure 5:
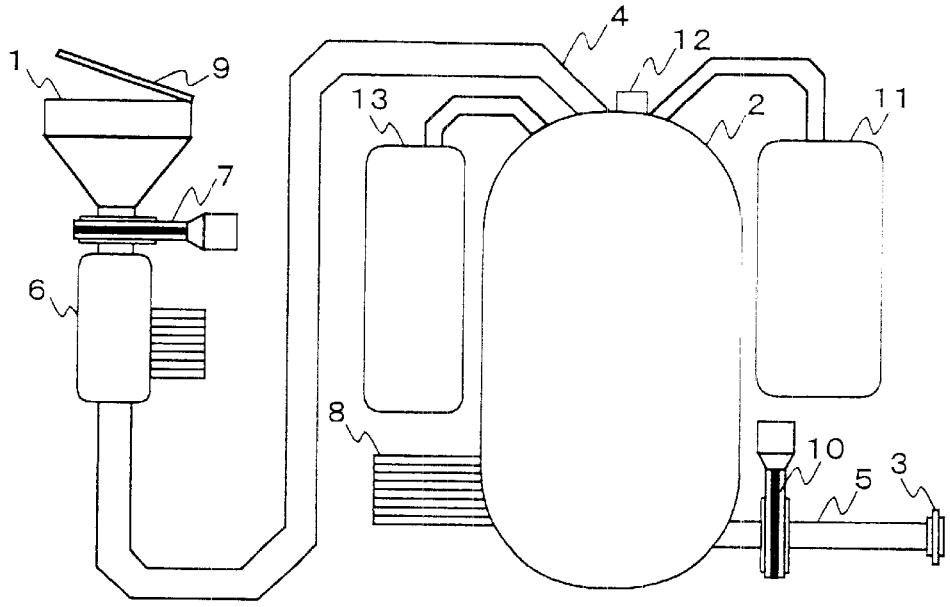
FIG. 5 is a conceptual diagram of an embodiment of a food waste shredding device according to the present invention.

Firstly, as shown in FIG. 5, the taking-in portion 4 and the inlet 1 are shut off using the inlet shut-off valve 7 and the discharge portion 5 and the storage tank 2 are shut off using the outlet shut-off valve 10. Then, the interior of the taking-in portion 4 and the interior of the storage tank 2 are evacuated using the evacuator device 11, so that the air pressure is reduced to −0.4 atm.

This air pressure can convey the food waste present inside the inlet 1 to the storage tank 2 and it can be appropriately set so that the shredded food waste inside the storage tank 2 is not sucked into the evacuator device 11.

Figure 6:
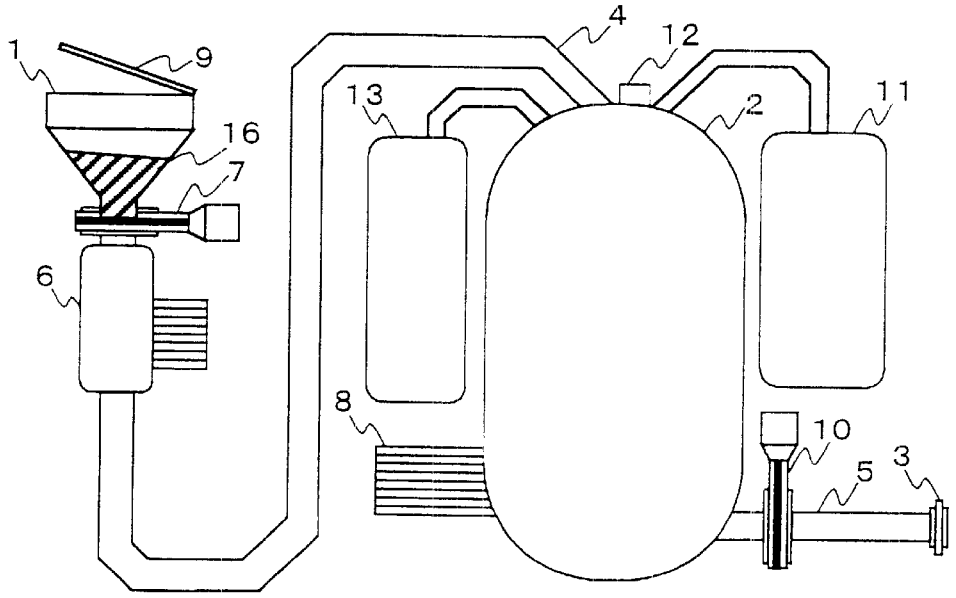
FIG. 6 is a conceptual diagram of an embodiment of a food waste shredding device according to the present invention.
Figure 7:
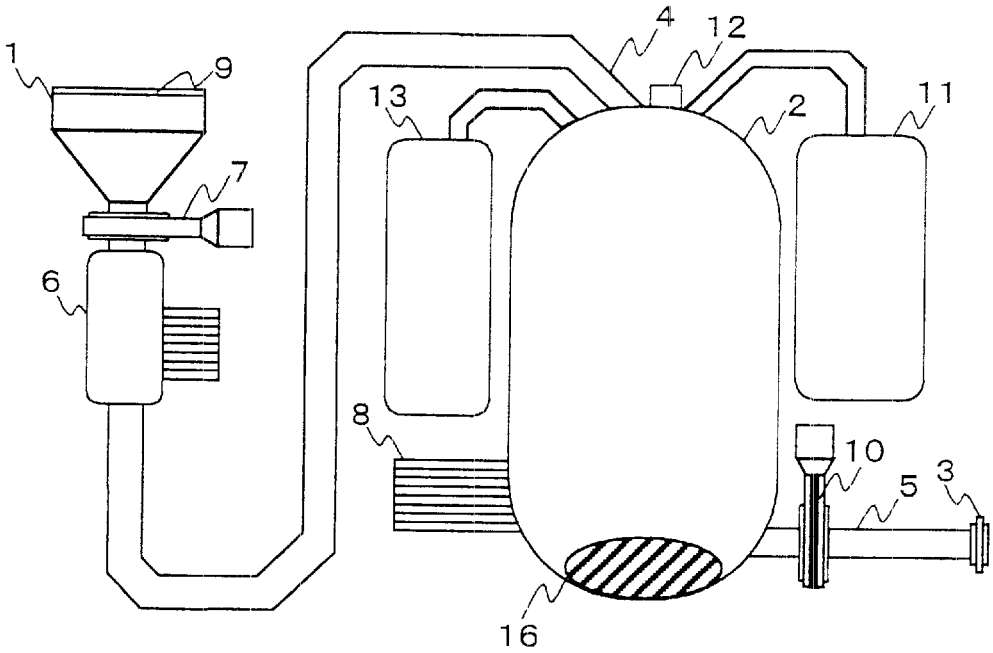
FIG. 7 is a conceptual diagram of an embodiment of a food waste shredding device according to the present invention.
Figure 8:
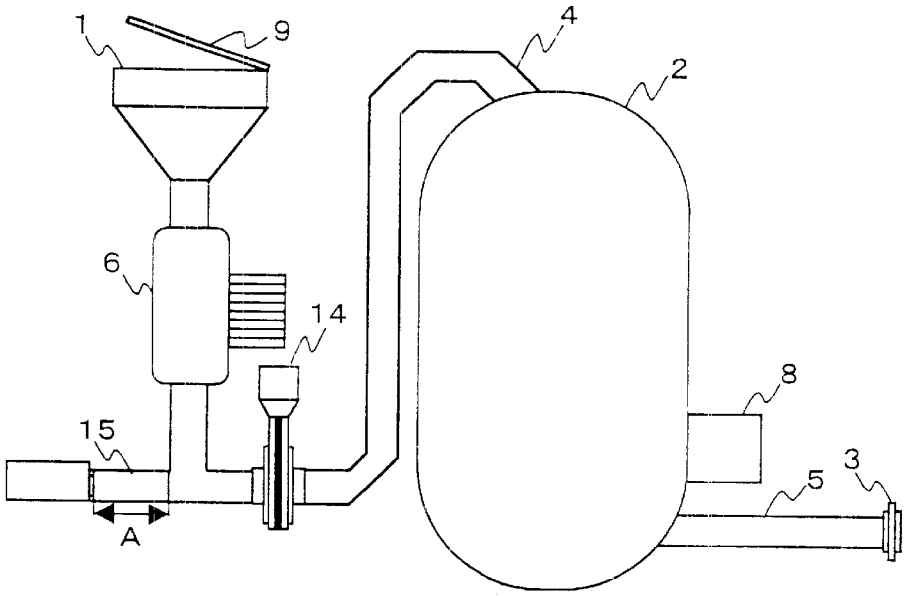
PRIOR ART Fig. 8
FIG. 8 is a conceptual diagram of a food waste shredding device according to the prior art.
Figure 9:
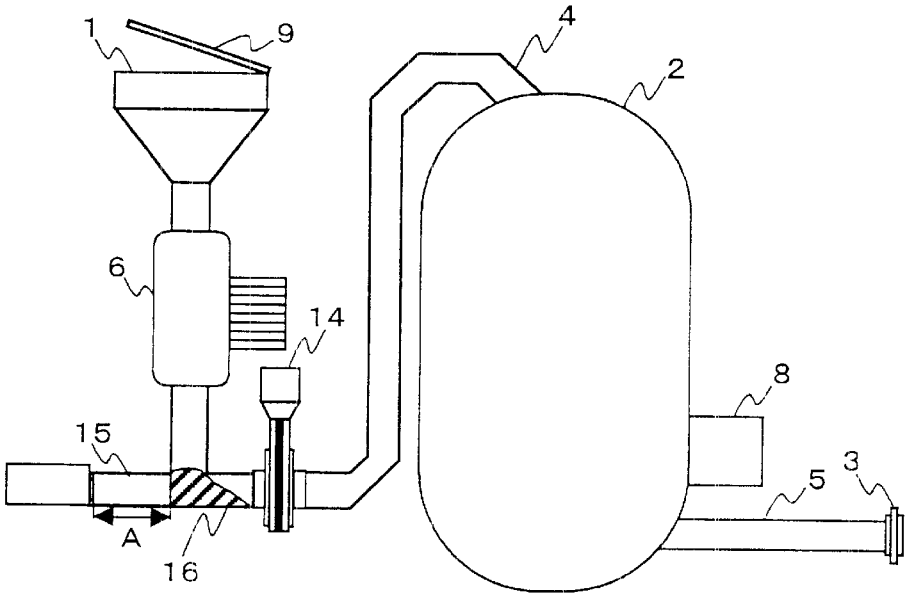
PRIOR ART Fig. 9
FIG. 9 is a conceptual diagram of a food waste shredding device according to the prior art.
Figure 10:
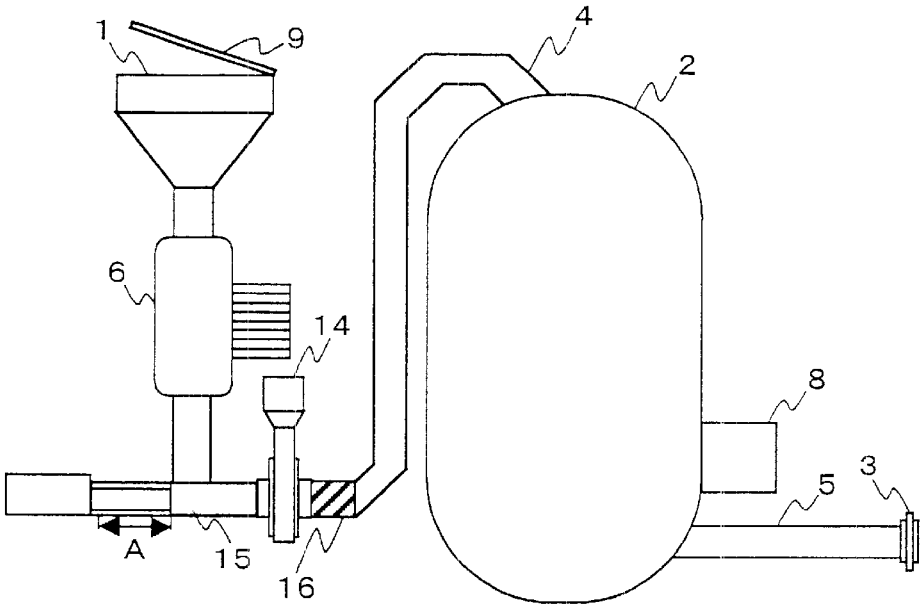
PRIOR ART Fig. 10
FIG. 10 is a conceptual diagram of a food waste shredding device according to the prior art.
Figure 11:
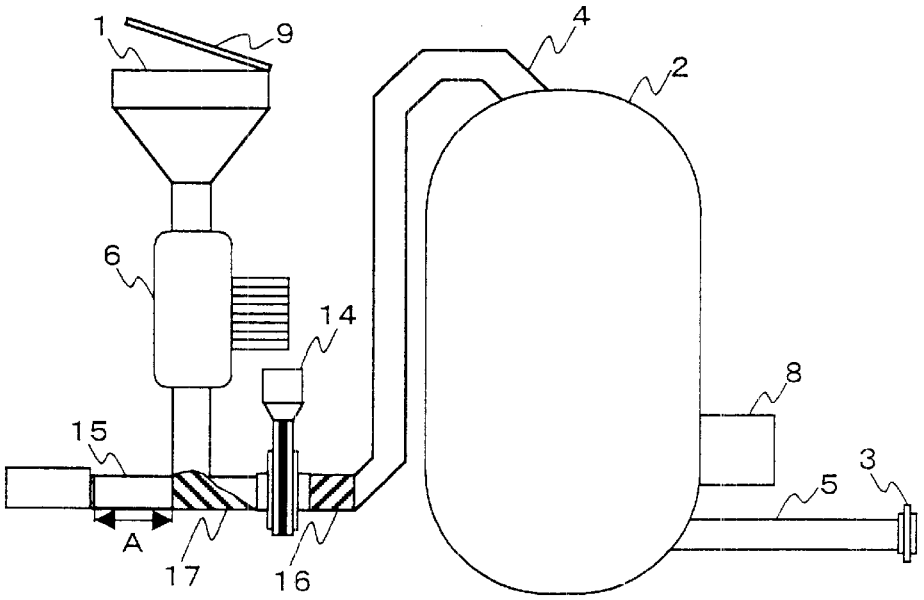
PRIOR ART Fig. 11
FIG. 11 is a conceptual diagram of a food waste shredding device according to the prior art.
Figure 12:
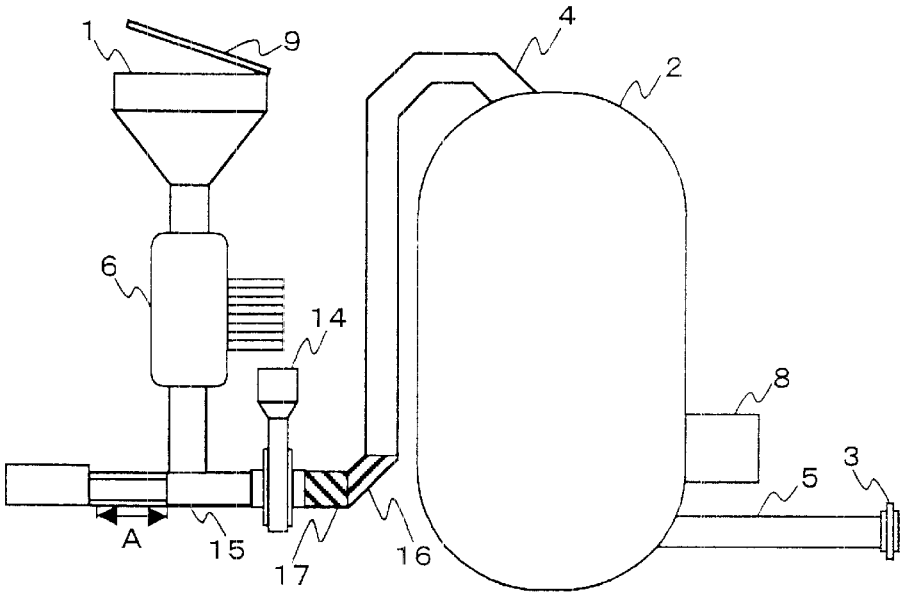
PRIOR ART Fig. 12
FIG. 12 is a conceptual diagram of a food waste shredding device according to the prior art.
Figure 13:
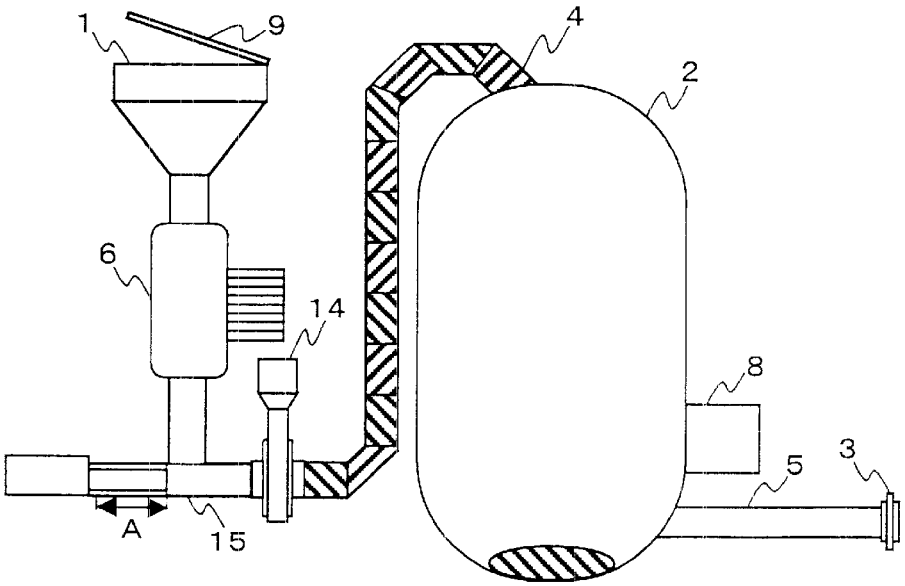
PRIOR ART Fig. 13
FIG. 13 is a conceptual diagram of a food waste shredding device according to the prior art.

Next, as shown in FIG. 6, the food waste is introduced into the inlet 1. Then, as shown in FIG. 7, the inlet shut-off valve 7 is opened. As a result of the inlet shut-off valve 7 opening, the food waste present inside the inlet 1 is conveyed to the interior of the storage tank 2 by the difference in air pressure between the inlet and the storage tank.

Various types of sensors are preferably arranged in the inlet 1 etc, and as a result of the inlet door 9 closing off the inlet 1, the inlet shut-off valve 7 opens automatically.

In addition, as the food waste is conveyed along, the food waste may be shredded using the shredding cutter 6 arranged inside the taking-in portion 4.

The food waste conveyed into the interior of the storage tank 2 is shredded using an agitator cutter 8. In addition, the agitator cutter 8 is used to agitate the food waste present inside the storage tank and to prevent the food waste from separating into liquid and solid. At this time it is possible to increase the air pressure inside the storage tank 2 using a compressor device 13. By pressurizing the interior of the storage tank it is possible to inhibit decomposition of the food waste accumulated inside the storage tank.

In addition, the quantity of the food waste accumulated inside the storage tank 2 is calculated from a distance between a detection sensor 12 arranged in the upper part of the food waste storage tank and the surface of the food waste. Data relating to the stored quantity of the food waste calculated in this way is sent at regular intervals to a control center which controls the food waste shredding device.

Data is regularly sent to the control center from state sensors (not shown in the figures) which are provided in the inlet shut-off valve, the shredding cutter, the evacuator device etc. for detecting operating states thereof. In addition, if the state sensors detect specific data relating to breakdowns or the like, the detected data is transmitted immediately to the control center.

The food waste conveyed to the interior of the storage tank 2 is discharged from the outlet 3 via the discharge portion 5 using taking-out vehicles and the like. When this occurs, the outlet 3 is opened by means of a card reader device (not shown in the figures) reading vehicle information and the like recorded on cards (not shown in the figures). At this time, the food waste also can be discharged from the outlet 3 by increasing the air pressure inside the storage tank 2 using the compressor device 13.

In addition, the quantity of food waste discharged can be detected by the state sensors or the detection sensor provided in the discharge portion or the outlet and sent to the control center together with the vehicle information.

What is claimed is:

1. A food waste shredding device comprising a shredding cutter which shreds and liquefies food waste introduced from a food waste inlet, a storage tank which stores liquefied food waste, an inlet shut-off valve which is provided between the food waste inlet and the shredding cutter and an evacuator device which evacuates an interior of the storage tank, wherein the interior of the storage tank is evacuated in advance by the evacuator device while the inlet shut-off valve is in a closed state and the inlet shut-off valve is opened when the food waste is introduced from the inlet, to thereby forcibly convey the food waste which has been shredded and liquefied using the cutter into the storage tank.

2. The food waste shredding device as claimed in claim 1, comprising a food waste outlet for discharging to outside the food waste which has been liquefied and stored in the storage tank and a compressor device which pressurizes the interior of the storage tank, wherein, when the food waste which has been liquefied and stored in the storage tank is discharged from the food waste outlet, the interior of the storage tank is pressurized by the compressor device, to thereby forcibly discharge the food waste which has been liquefied and stored in the storage tank to the outside.

3. The food waste shredding device as claimed in claim 1, comprising:

a detection sensor for detecting a quantity of the food waste stored inside the storage tank;

state sensors for detecting operating states of at least the inlet shut-off valve, the shredding cutter and the evacuator device; and a communication device for reporting to a remote control center device detection results of the detection sensor and of the state sensors.

4. The food waste shredding device as claimed in claim 1, wherein the food waste inlet is provided with a door and, when the door is closed, the inlet shut-off valve opens.

5. A food waste shredding method in which food waste introduced from a food waste inlet is shred by a shredding cutter and liquefied and the liquefied food waste is stored in a storage tank, wherein an interior of the storage tank is evacuated while an inlet shut-off valve provided between the inlet and the shredding cutter is in a closed state, the inlet shut-off valve is opened when the food waste from the food waste inlet is introduced, so as to forcibly convey the food waste shredded and liquefied using the shredding cutter into the storage tank.

6. The food waste shredding method as claimed in claim 5, wherein, when the food waste which has been liquefied and stored in the storage tank is discharged from a food waste outlet provided on the storage tank, the interior of the storage tank is pressurized to thereby forcibly discharge the liquefied food waste which has been stored in the storage tank to outside.

* * * * *